US012162642B1

(12) United States Patent
Namanny

(10) Patent No.: US 12,162,642 B1
(45) Date of Patent: Dec. 10, 2024

(54) GARBAGE BAG OPENER DEVICE

(71) Applicant: Eric Namanny, Weed, CA (US)

(72) Inventor: Eric Namanny, Weed, CA (US)

( * ) Notice: Subject to any disclaimer, the term of this patent is extended or adjusted under 35 U.S.C. 154(b) by 0 days.

(21) Appl. No.: 18/207,567

(22) Filed: Jun. 8, 2023

(51) Int. Cl.
*B65B 67/12* (2006.01)

(52) U.S. Cl.
CPC ..... *B65B 67/1205* (2013.01); *B65B 67/1255* (2013.01)

(58) Field of Classification Search
CPC ..... B65B 67/1205; B65B 67/1238; B65B 67/1227; B65B 67/1255; B65B 67/12; E05D 11/10; E05D 11/1007; E05D 11/06
USPC ..... 248/99–101; 383/33–34, 34.1; 16/231, 16/267, 270; 403/91–92
See application file for complete search history.

(56) References Cited

U.S. PATENT DOCUMENTS 214,721 A * 4/1879 Smith ..... B65B 67/12 248/224.7
1,371,751 A * 3/1921 Fuller ..... G01M 3/04 220/9.2
1,427,123 A * 8/1922 Pulig ..... B65B 67/1255 248/99
1,653,393 A * 12/1927 Cox ..... B65B 67/1205 141/390
2,670,932 A * 3/1954 Westerfors ..... A47D 13/06 403/92
3,260,488 A * 7/1966 Kliewer ..... B65B 67/1244 383/68
4,159,139 A 6/1979 Gawedzinski
4,537,377 A 8/1985 Shewchuk
4,561,480 A * 12/1985 Underwood ..... A01G 20/43 383/117
4,815,866 A * 3/1989 Martone ..... B65B 67/1238 141/390
5,149,028 A 9/1992 Blackaby
5,163,645 A * 11/1992 Caruso ..... B65B 67/1227 383/7
5,451,107 A * 9/1995 Ricker ..... B65F 1/00 383/34
5,743,651 A * 4/1998 Steinmetz ..... B65F 1/1415 383/33
5,927,856 A 7/1999 Hung
6,302,583 B1 * 10/2001 Steinmetz ..... B65B 67/12 383/33
6,471,267 B2 * 10/2002 Asazuma ..... A01K 23/005 294/1.5
D654,646 S 2/2012 Williams
(Continued)

FOREIGN PATENT DOCUMENTS

GB 2166041 4/1986

*Primary Examiner* — Ingrid M Weinhold

(57) ABSTRACT

A garbage bag opener device includes a pair of arms hingedly coupled together for inserting into a band opening in a neck of a garbage bag. The pair of arms is positionable in a deployed position to hold the garbage bag open for receiving garbage. A pair of pins is each attached to a respective one of the pair of arms and a latch is rotatably attached to a respective one of the pair of pins. The latch is positionable in a locked position to engage the other of the pair of pins when the arms are in the deployed position for retaining the pair of arms in the deployed position. The latch is positionable in an unlocked position to disengage the other of the pins to facilitate the pair of arms to be positioned in the stored position.

6 Claims, 6 Drawing Sheets

(56) References Cited

U.S. PATENT DOCUMENTS

| | | | | |
|---|---|---|---|---|
| 8,147,140 | B2 * | 4/2012 | Williams | B65F 1/0006 383/33 |
| 9,926,133 | B1 | 3/2018 | Alrumaih | |
| 2004/0195467 | A1 | 10/2004 | Passage | |

* cited by examiner

GARBAGE BAG OPENER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to garbage bag devices and more particularly pertains to a new garbage bag device for holding a garbage bag open for filling the garbage bag with garbage. The device includes a pair of arms hingedly attached together which can be inserted into a band opening in a neck of a garbage bag. The arms are positionable in a deployed position to hold the neck of the garbage bag open and the device includes a latch that is positionable in a locked position for retaining the arms in the deployed position.

(2) Description of Related Art Including Information Disclosed Under 37 CFR 1.97 and 1.98

The prior art relates to garbage bag devices including a variety of trash bag holder devices for holding a trach bag open which each includes a gripping mechanism that is attachable to an outside of a trash bag for holding the trash bag open. In no instance does the prior art disclose a garbage bag opener that includes a pair of arms that are insertable into a neck of a garbage bag for holding the neck open.

BRIEF SUMMARY OF THE INVENTION

An embodiment of the disclosure meets the needs presented above by generally comprising a pair of arms hingedly coupled together for inserting into a band opening in a neck of a garbage bag. The pair of arms is positionable in a deployed position to hold the garbage bag open for receiving garbage. A pair of pins is each attached to a respective one of the pair of arms and a latch is rotatably attached to a respective one of the pair of pins. The latch is positionable in a locked position to engage the other of the pair of pins when the arms are in the deployed position for retaining the pair of arms in the deployed position. The latch is positionable in an unlocked position to disengage the other of the pins to facilitate the pair of arms to be positioned in the stored position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
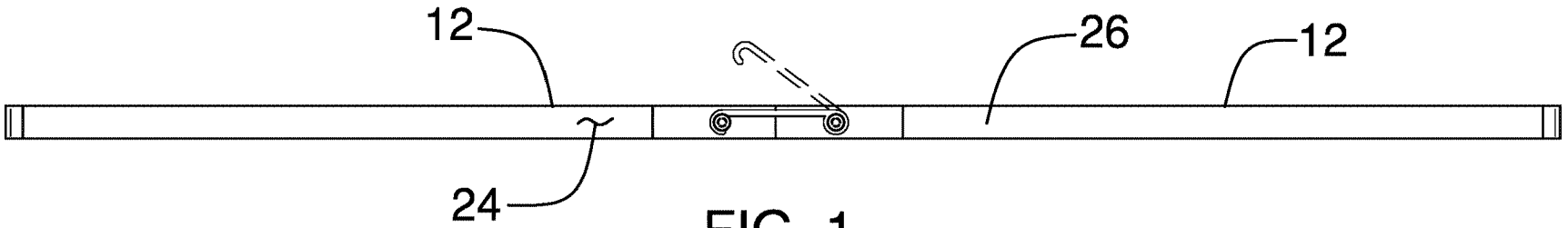
FIG. 1 is a front view of an embodiment of the disclosure.
Figure 2:
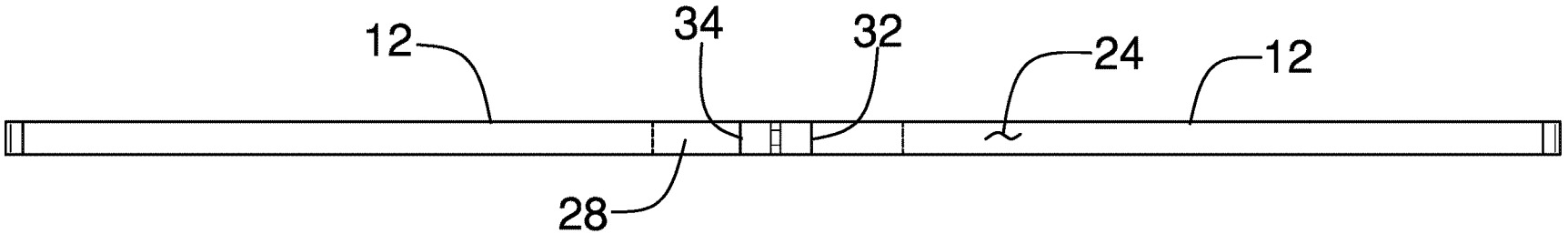
FIG. 2 is a back view of an embodiment of the disclosure.
Figure 3:
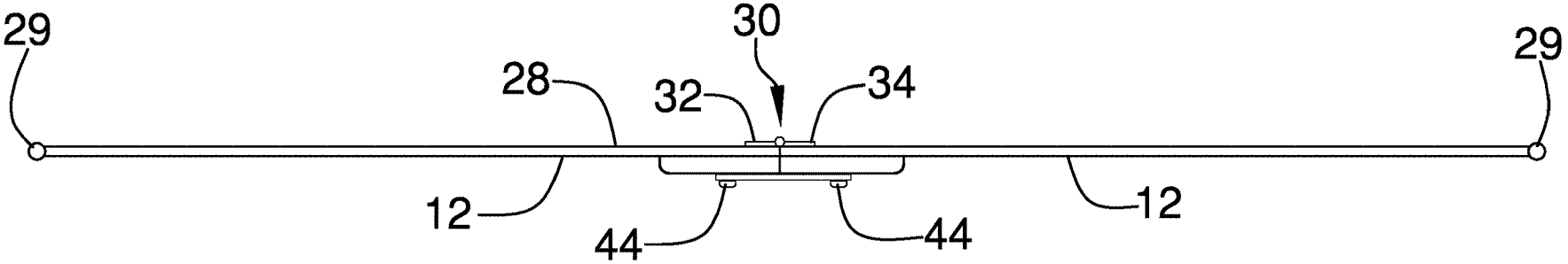
FIG. 3 is a top view of an embodiment of the disclosure.
Figure 4:
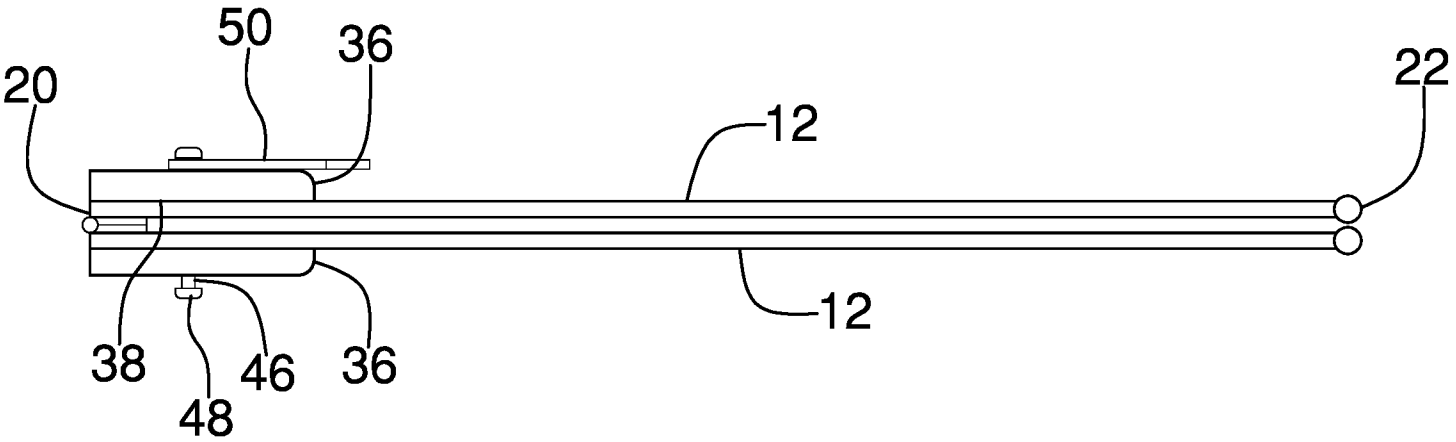
FIG. 4 is a bottom view of an embodiment of the disclosure showing a pair of arms in a stored position.
Figure 5:
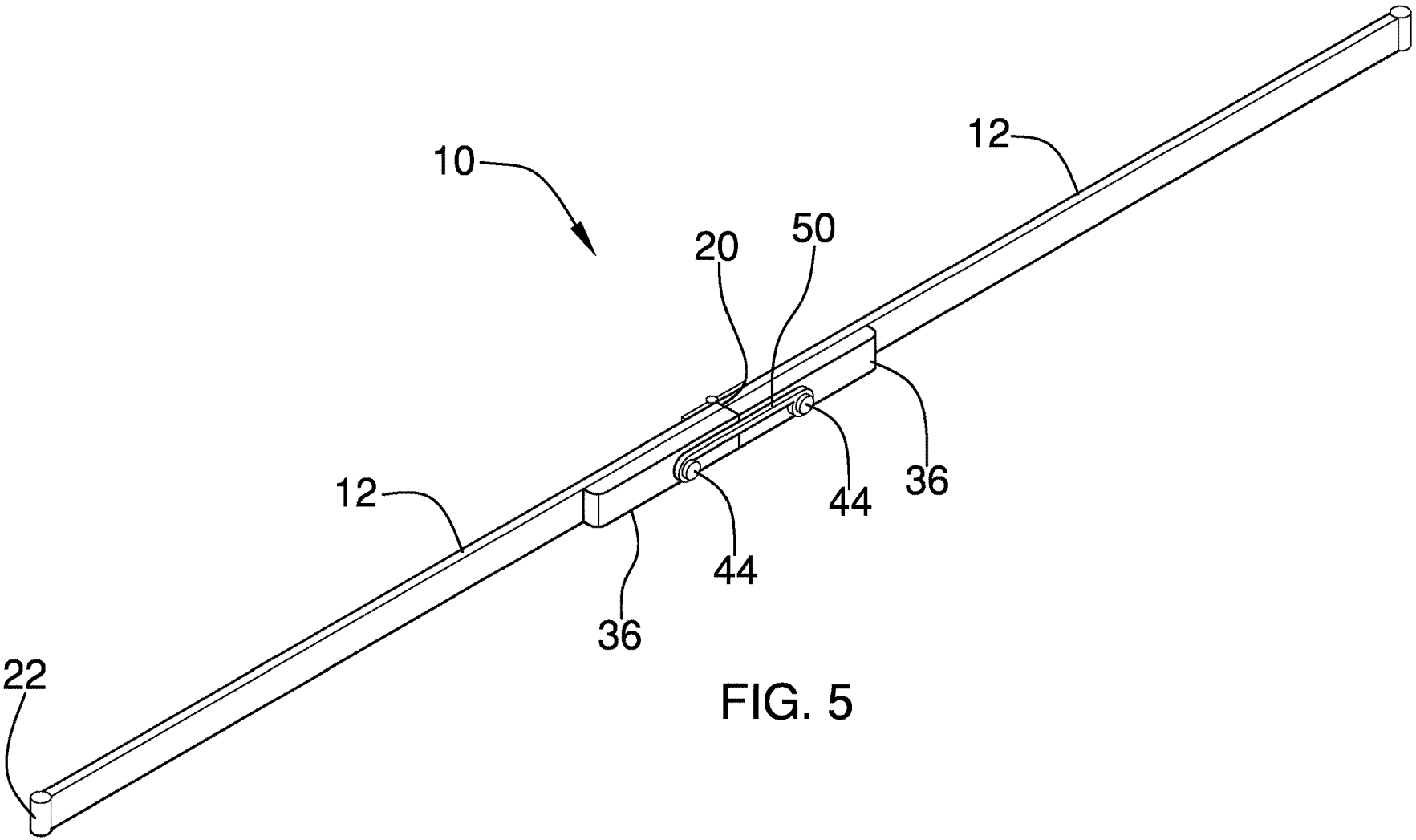
FIG. 5 is a front perspective view of a garbage bag opener device according to an embodiment of the disclosure.
Figure 6:
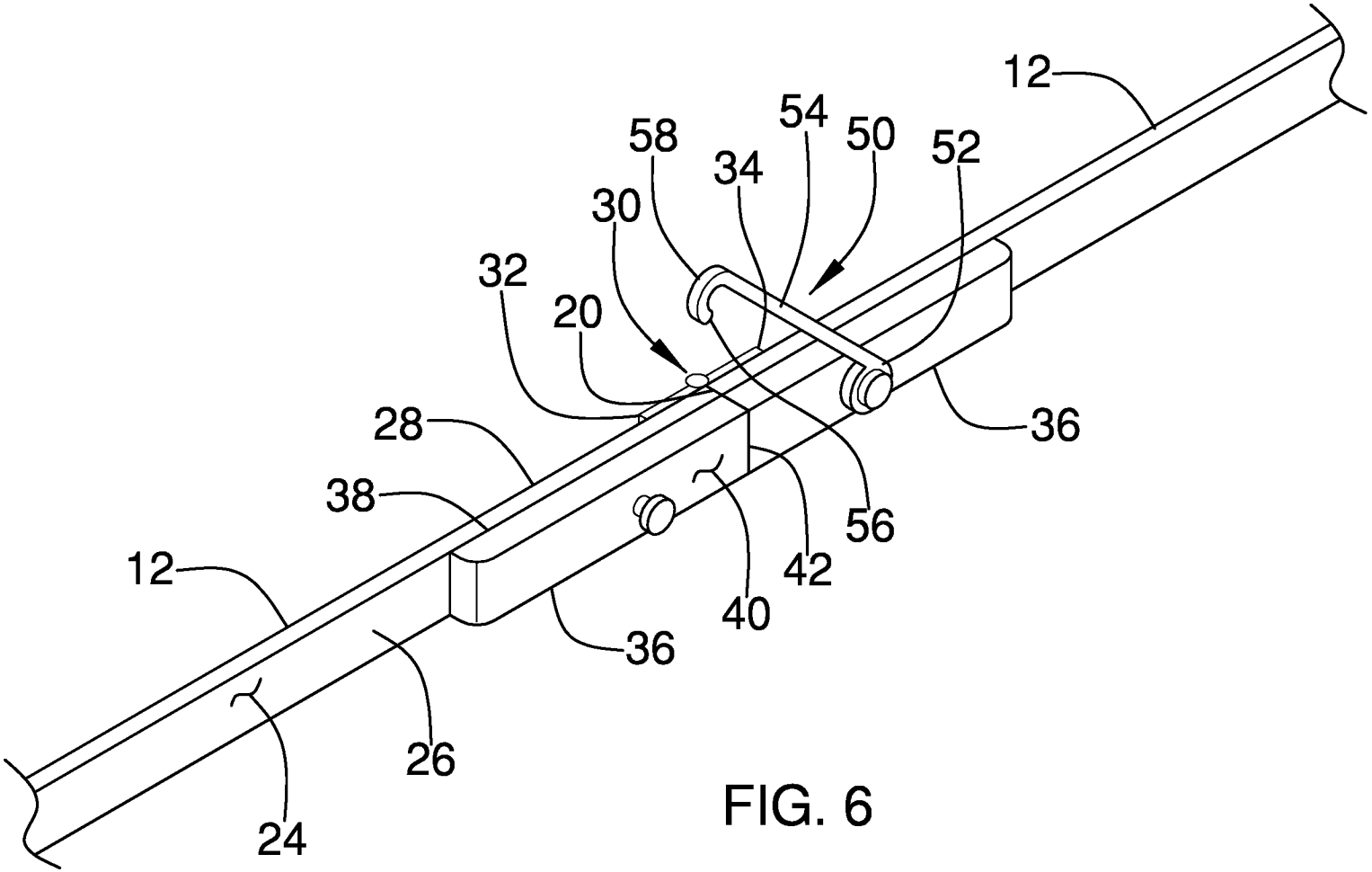
FIG. 6 is a perspective detail view of a pair of grips and a latch of an embodiment of the disclosure.
Figure 7:
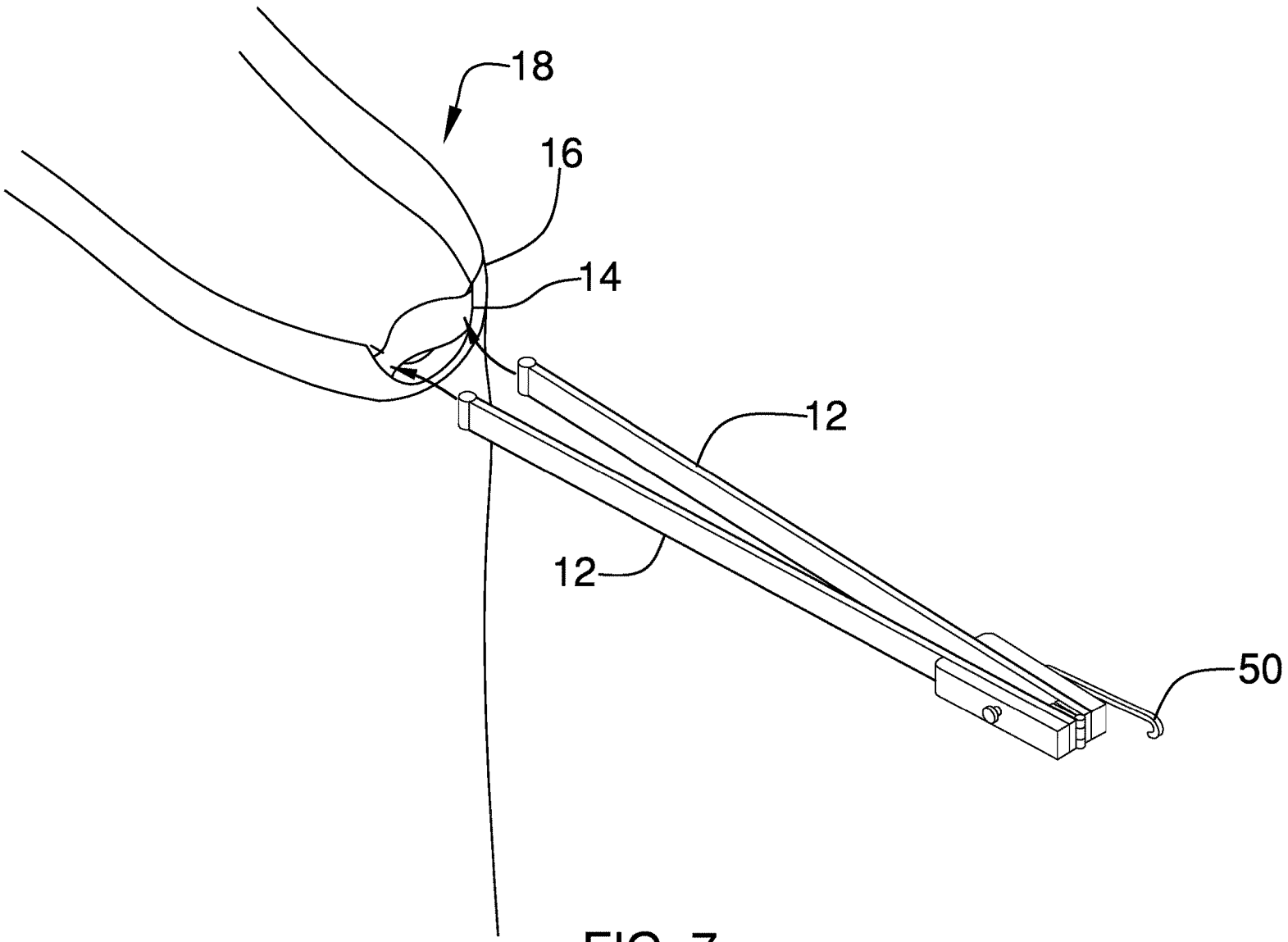
FIG. 7 is a perspective in-use view of an embodiment of the disclosure showing a pair of arms being inserted into a band opening in a neck of a garbage bag.
Figure 8:
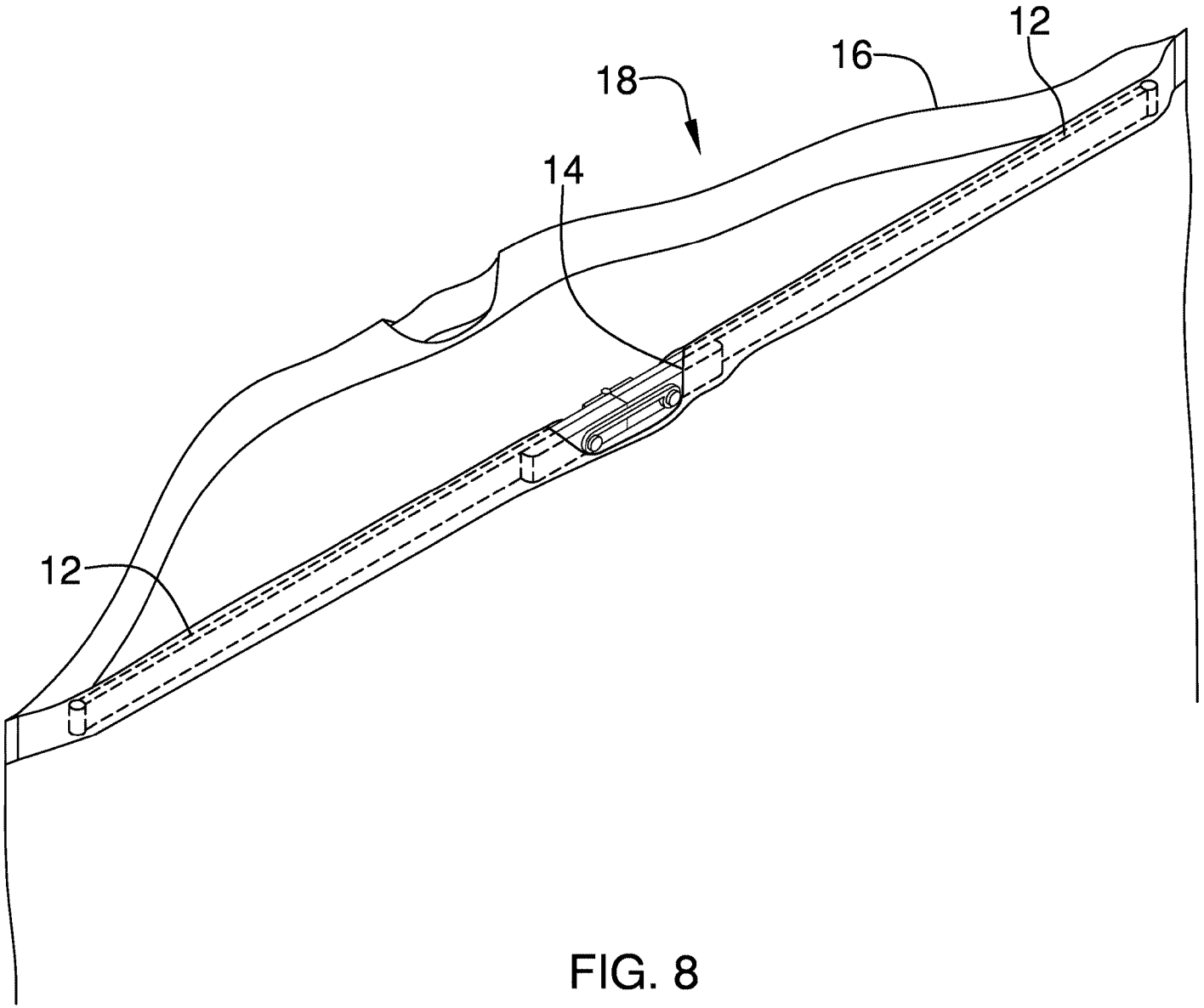
FIG. 8 is a perspective in-use view of an embodiment of the disclosure showing a pair of arms deployed in a neck of a garbage bag.

With reference now to the drawings, and in particular to FIGS. 1 through 8 thereof, a new garbage bag device embodying the principles and concepts of an embodiment of the disclosure and generally designated by the reference numeral 10 will be described.

As best illustrated in FIGS. 1 through 8, the garbage bag opener device 10 generally comprises a pair of arms 12 hingedly coupled together such that the pair of arms 12 can be inserted into a band opening 14 in a neck 16 of a garbage bag 18. The pair of arms 12 are positionable in a deployed position having the pair of arms 12 extending laterally away from each other. In this way the pair of arms 12 can hold the garbage bag 18 open for receiving garbage. The pair of arms 12 are positionable in a stored position having the arms 12 lying against each other.

Each of the pair of arms 12 has a first end 20, a second end 22 and an outer surface 24 extending between the first end 20 and the second end 22 and the outer surface 24 has a front side 26 and a back side 28. The first end 20 of each of the pair of arms 12 is positioned adjacent to each other. Additionally, the second end 22 of each of the pair of arms 12 is rounded to inhibit catching on the garbage bag 18 when the pair of arms 12 is inserted into the band opening 14 in the neck 16 of the garbage bag 18. A cylinder 29 may be attached to the second end 22 of each of the arms 12 to facilitate the second end 22 to be rounded. Each of the arms 12 may have a length ranging between approximately 25.0 cm and 35.0 cm.

A hinge 30 is included which has a first panel 32 that is hingedly coupled to a second panel 34. Each of the first panel 32 and the second panel 34 lies against the back side 28 of the outer surface 24 of a respective one of the arms 12 having each of the first panel 32 and the second panel 34 being attached to the back side 28. The first end 20 of each of the pair of arms 12 abuts each other when the pair of arms 12 is in the deployed position. The second end 22 of each of the pair of arms 12 is spaced apart from each other when the pair of arms 12 is in the stored position.

A pair of grips 36 is provided and each of the grips 36 is attached to a respective one of the pair of arms 12. Each of the grips 36 has a coupled surface 38, an exposed surface 40 and a primary end 42 extending between the coupled surface 38 and the exposed surface 40. The coupled surface 38 of each of the pair of grips 36 is coupled to the front side 26 of the outer surface 24 of the pair of arms 12. The primary end 42 of each of the pair of grips 36 abuts each other when the pair of arms 12 is in the deployed position.

A pair of pins 44 is each attached to a respective one of the pair of grips 36. Each of the pins 44 has a stem 46 extending away from the exposed surface 40 of a respective one of the grips 36 and a head 48 that is spaced from the exposed surface 40 of the respective grip 36. A latch 50 is provided and the latch 50 is rotatably attached to a respective one of the pair of pins 44. The latch 50 is positionable in a locked position to engage the other of the pair of pins 44 when the arms 12 are in the deployed position for retaining the pair of arms 12 in the deployed position. Conversely, the latch 50 is positionable in an unlocked position to disengage the other of the pins 44 to facilitate the pair of arms 12 to be positioned in the stored position.

The latch 50 has a closed ring 52 extending around the stem 46 of the respective pin 44 and a finger 54 extending away from the closed ring 52. The finger 54 has a distal end 56 with respect to the closed ring 52. Furthermore, the finger 54 has a curve 58 adjacent to the distal end 56 such that the distal end 56 is directed toward the closed ring 52. The curve 58 extends around the stem 46 of the other of the pins 44 when the latch 50 is positioned in the locked position.

In use, the second end 22 of each of the pair of arms 12 is inserted into the band opening 14 in the neck 16 of the garbage bag 18 and the pair of arms 12 is positioned in the deployed position to hold the neck 16 of the garbage bag 18 open. Additionally, the latch 50 is moved into the locking position to retain the arms 12 in the deployed position. In this way the garbage bag 18 can be filled with garbage without requiring a person to hold the garbage bag 18 open. The latch 50 is moved into the unlocking position and the arms 12 are moved out of the deployed position to facilitate the pair of arms 12 to be removed from the band opening 14.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage bag opener assistance device comprising:

a pair of arms, said pair of arms being hingedly coupled together wherein said pair of arms is configured to be inserted into a band opening in a neck of a garbage bag, said pair of arms being positionable in a deployed position having said pair of arms being coplanar, said pair of arms being positionable in a stored position having said arms lying substantially parallel with each other;

a pair of grips, each of said grips being attached to a respective one of said pair of arms;

a pair of pins, each of said pins being attached to a respective one of said pair of grips;

a latch being rotatably attached to a respective one of said pair of pins, said latch being positionable in a locked position to engage the other of said pair of pins when said arms are in said deployed position for retaining said pair of arms in said deployed position, said latch being positionable in an unlocked position to disengage said other of said pins to facilitate said pair of arms to be positioned in said stored position;

wherein each of said pair of arms has a first end, a second end and an outer surface extending between said first end and said second end, said outer surface having a front side and a back side:

wherein said first end of each of said pair of arms is positioned adjacent to each other;

wherein said second end of each of said pair of arms being rounded wherein said second end of each of said pair of arms is configured to inhibit catching on the garbage bag when said pair of arms is inserted into the band opening in the neck of the garbage bag; and wherein said device includes a hinge having a first panel hingedly coupled to a second panel, each of said first panel and said second panel lying against said back side of said outer surface of a respective one of said arms having each of said first panel and said second panel being attached to said back side.

2. The device according to claim 1, wherein:

said first end of each of said pair of arms abuts each other when said pair of arms is in said deployed position; and said second end of each of said pair of arms is spaced apart from each other when said pair of arms is in said deployed position.

3. The device according to claim 1, wherein each of said grips has a coupled surface, an exposed surface and a primary end extending between said coupled surface and said exposed surface, said coupled surface of each of said pair of grips being coupled to a front side of an outer surface of said pair of arms, said primary end of each of said pair of grips abutting each other when said pair of arms is in said deployed position.

4. The device according to claim 3, wherein:

each of said pins has a stem extending away from said exposed surface of a respective one of said grips and a head being spaced from said exposed surface of said respective grip; and said latch has a closed ring extending around said stem of said respective pin and a finger extending away from said closed ring, said finger having a distal end with respect to said closed ring, said finger having a curve adjacent to said distal end such that said distal end is directed toward said closed ring, said curve extending around said stem of said other of said pins when said latch is positioned in said locked position.

5. A garbage bag opener assistance device comprising:

a pair of arms, said pair of arms being hingedly coupled together wherein said pair of arms is configured to be inserted into a band opening in a neck of a garbage bag, said pair of arms being positionable in a deployed position having said pair of arms being coplanar, said pair of arms being positionable in a stored position having said arms lying substantially parallel with each other, each of said pair of arms having a first end, a second end and an outer surface extending between said first end and said second end, said outer surface having a front side and a back side, said first end of each of said pair of arms being positioned adjacent to each other, said second end of each of said pair of arms being rounded wherein said second end of each of said pair of arms is configured to inhibit catching on the garbage bag when said pair of arms is inserted into the band opening in the neck of the garbage bag;

a hinge having a first panel hingedly coupled to a second panel, each of said first panel and said second panel lying against said back side of said outer surface of a respective one of said arms having each of said first panel and said second panel being attached to said back side, said first end of each of said pair of arms abutting each other when said pair of arms is in said deployed position, said second end of each of said pair of arms being spaced apart from each other when said pair of arms is in said deployed position;

a pair of grips, each of said grips being attached to a respective one of said pair of arms, each of said grips having a coupled surface, an exposed surface and a primary end extending between said coupled surface and said exposed surface, said coupled surface of each of said pair of grips being coupled to said front side of said outer surface of said pair of arms, said primary end of each of said pair of grips abutting each other when said pair of arms is in said deployed position;

a pair of pins, each of said pins being attached to a respective one of said pair of grips, each of said pins having a stem extending away from said exposed surface of a respective one of said grips and a head being spaced from said exposed surface of said respective grip; and a latch being rotatably attached to a respective one of said pair of pins, said latch being positionable in a locked position to engage the other of said pair of pins when said arms are in said deployed position for retaining said pair of arms in said deployed position, said latch being positionable in an unlocked position to disengage said other of said pins to facilitate said pair of arms to be positioned in said stored position, said latch having a closed ring extending around said stem of said respective pin and a finger extending away from said closed ring, said finger having a distal end with respect to said closed ring, said finger having a curve adjacent to said distal end such that said distal end is directed toward said closed ring, said curve extending around said stem of said other of said pins when said latch is positioned in said locked position.

6. A garbage bag assistance opener system comprising:

a garbage bag having a neck, said garbage bag having a band opening extending into said neck;

a garbage bag opener assistance device having:

a pair of arms, said pair of arms being hingedly coupled together, said pair of arms being insertable into said band opening in said neck of said garbage bag, said pair of arms being positionable in a deployed position having said pair of arms being coplanar, said pair of arms being positionable in a stored position having said arms lying substantially parallel with each other, each of said pair of arms having a first end, a second end and an outer surface extending between said first end and said second end, said outer surface having a front side and a back side, said first end of each of said pair of arms being positioned adjacent to each other, said second end of each of said pair of arms being rounded thereby inhibiting said second end of each of said pair of arms from catching on said garbage bag when said pair of arms is inserted into said band opening in said neck of said garbage bag;

a hinge having a first panel hingedly coupled to a second panel, each of said first panel and said second panel lying against said back side of said outer surface of a respective one of said arms having each of said first panel and said second panel being attached to said back side, said first end of each of said pair of arms abutting each other when said pair of arms is in said deployed position, said second end of each of said pair of arms being spaced apart from each other when said pair of arms is in said deployed position;

a pair of grips, each of said grips being attached to a respective one of said pair of arms, each of said grips having a coupled surface, an exposed surface and a primary end extending between said coupled surface and said exposed surface, said coupled surface of each of said pair of grips being coupled to said front side of said outer surface of said pair of arms, said primary end of each of said pair of grips abutting each other when said pair of arms is in said deployed position;

a pair of pins, each of said pins being attached to a respective one of said pair of grips, each of said pins having a stem extending away from said exposed surface of a respective one of said grips and a head being spaced from said exposed surface of said respective grip; and a latch being rotatably attached to a respective one of said pair of pins, said latch being positionable in a locked position to engage the other of said pair of pins when said arms are in said deployed position for retaining said pair of arms in said deployed position, said latch being positionable in an unlocked position to disengage said other of said pins to facilitate said pair of arms to be positioned in said stored position, said latch having a closed ring extending around said stem of said respective pin and a finger extending away from said closed ring, said finger having a distal end with respect to said closed ring, said finger having a curve adjacent to said distal end such that said distal end is directed toward said closed ring, said curve extending around said stem of said other of said pins when said latch is positioned in said locked position.

* * * * *